US006464117B1

(12) United States Patent
Cares

(10) Patent No.: US 6,464,117 B1
(45) Date of Patent: Oct. 15, 2002

(54) GARMENT CLAMP FOR SHIRT PRESSING MACHINE

(75) Inventor: Paul Cares, Alto, MI (US)

(73) Assignee: P&L Company, Kentwood, MI (US)

( * ) Notice: Subject to any disclaimer, the term of this patent is extended or adjusted under 35 U.S.C. 154(b) by 0 days.

(21) Appl. No.: 09/629,087

(22) Filed: Jul. 31, 2000

(51) Int. Cl.[7] ..... D06C 15/00
(52) U.S. Cl. ..... 223/52
(58) Field of Search ..... 223/72, 52, 51, 223/61; 38/12, 17, 82, 71; 112/235, 237, 238, 239

(56) References Cited

U.S. PATENT DOCUMENTS

| | | | | |
|---|---|---|---|---|
| 1,781,580 A | | 11/1930 | Heliot | |
| 1,885,044 A | | 10/1932 | Belmont | |
| 2,175,308 A | | 10/1939 | Peyton et al. | |
| 4,004,720 A | * | 1/1977 | Cartabbia | 223/57 |
| 4,981,094 A | * | 1/1991 | Staple et al. | 112/235 |
| 5,181,333 A | | 1/1993 | Gilbert | 38/15 |
| 5,636,773 A | * | 6/1997 | Harrod et al. | 223/57 |

OTHER PUBLICATIONS

Ajax Division, American Laundry Machinery Inc., *Model CBS Cabinet Bag Sleever* (*shirt*), Product Code 363, pp. 3–1 to 3–6.

* cited by examiner

*Primary Examiner*—Rodney M. Lindsey
*Assistant Examiner*—James G Smith
(74) *Attorney, Agent, or Firm*—Reising, Ethington, Barnes, Kisselle, Learman & McCulloch, P.C.

(57) ABSTRACT

A garment clamp apparatus for stabilizing a shirt during pressing of the sleeves. The apparatus is for use on a shirt pressing machine of the type having a housing, a plurality of press platens supported by the housing, and a movable tray carrying sleeve supports or bucks. The garment clamp apparatus includes a clamp for securely mounting the apparatus to the support structure of the housing. A frame extends forwardly from the clamp between the press platens. A pneumatic cylinder connects the frame with an extendable foot, which is movable linearly against the bias of a pair of return springs between a retracted position and an extended position. In the extended position, the foot engages the shirt in the area between the sleeves and holds the sleeves taut on the sleeve supports for the pressing operation. Guide shaft assemblies are disposed between the frame and the foot. The pneumatic cylinder can be connected into the existing pneumatic control system without modification of the control algorithm.

37 Claims, 2 Drawing Sheets

GARMENT CLAMP FOR SHIRT PRESSING MACHINE

TECHNICAL FIELD

The present invention relates to an apparatus for holding a shirt to retain the shirt sleeves in the correct position for pressing.

BACKGROUND OF THE INVENTION

Shirt pressing machines are used by commercial laundries to press the sleeves of dress shirts after the laundering process. The pressing machines typically include a pair of vertically extending sleeve supports over which the shirt is placed and then pressed. Operators of the machines have pulled the sleeves over the supports and then press down, with their hands, on the garment in the location between the sleeves to maintain them taut during the pressing operations. However, due to frequent burns and other operator-related injuries, pressing machines today are typically designed to require two-handed operation to start the pressing operation. Although this design helps prevent injuries, it does not enable the operator to hold the shirt sleeves taut when the pressing operation begins. In some commercial laundries, a weighted object, such as a beanbag, has been placed between the sleeves to keep them taut. Others disable the two handed operation so that the shirt can be held in place, thereby increasing the risk of injury.

Shirt pressing machines are known that hold the shirt in the area between the sleeves. These are shown in U.S. Pat. No. 2,175,308 to Peyton et al, and U.S. Pat. No. 1,885,044 to Belmont. Each of these machines requires pivotal movement of the member that holds the shirt taut prior to pressing. To achieve this, the member must be pivotally secured to the machine behind the area where the member is to act. Such a design is not practical on today's commercial pressing machines, which are compact and typically have other parts of the machine immediately behind the area in which the member is located. For example, the main hydraulic cylinder used to activate the press elements is typically located immediately behind the member. Such a design prohibits the ability to use pivotal movement of the member, as the machine would interfere with such movement.

SUMMARY OF THE INVENTION

An apparatus for stabilizing a shirt during the pressing operation of the sleeves is provided. The apparatus comprises a frame and a clamp connected to the frame. The apparatus further includes a cylinder connected to the frame. A foot is connected to the cylinder. The foot is movable linearly between a retracted position and an extended position.

According to the present invention, there is provided a portable apparatus movable linearly to hold the sleeves taut during the pressing operation.

It is an object of the present invention to provide an apparatus for holding a shirt taut during the pressing operation, which apparatus contains a linearly moving member.

It is another object of the present invention to provide a shirt pressing machine having a linearly extending foot for holding the shirt sleeves taut during the pressing operation.

It is another object of the present invention to provide an apparatus including a foot that includes a contact rail having an upturned end at the end thereof to prevent the foot from becoming snagged on the shirt.

It is another object of the present invention to provide an apparatus for stabilizing shirts during the sleeve pressing operation that can be added to virtually any type of shirt pressing machine.

DESCRIPTION OF THE DRAWINGS

A preferred exemplary embodiment of the present invention will hereinafter be described in conjunction with the appended drawings, wherein like designations denote like elements, and.

DESCRIPTION OF THE PREFERRED EMBODIMENTS

Figure 1:
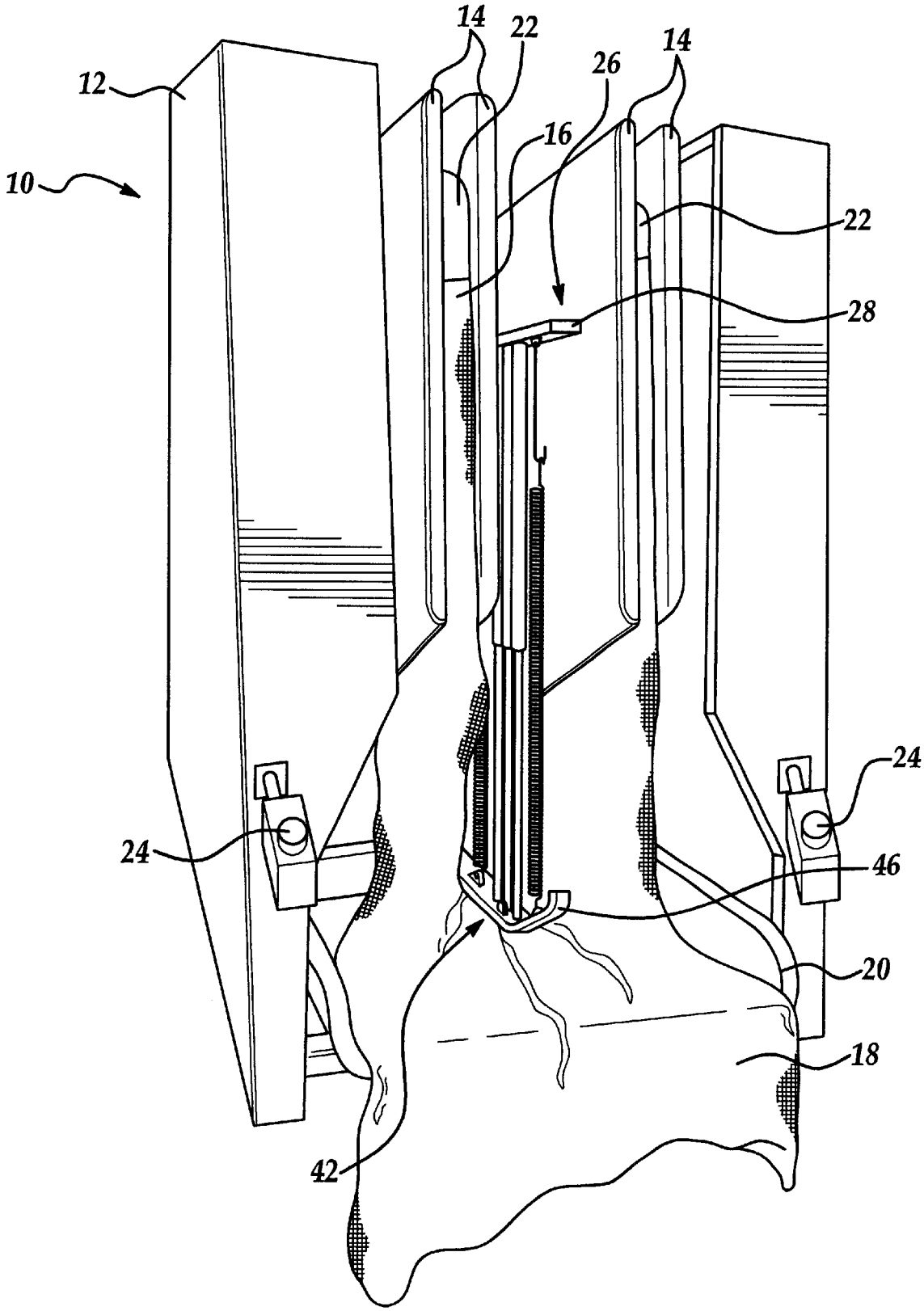
FIG. 1 is a perspective view of a pressing machine showing a preferred embodiment of a garment clamp apparatus of the present invention.
Figure 2:
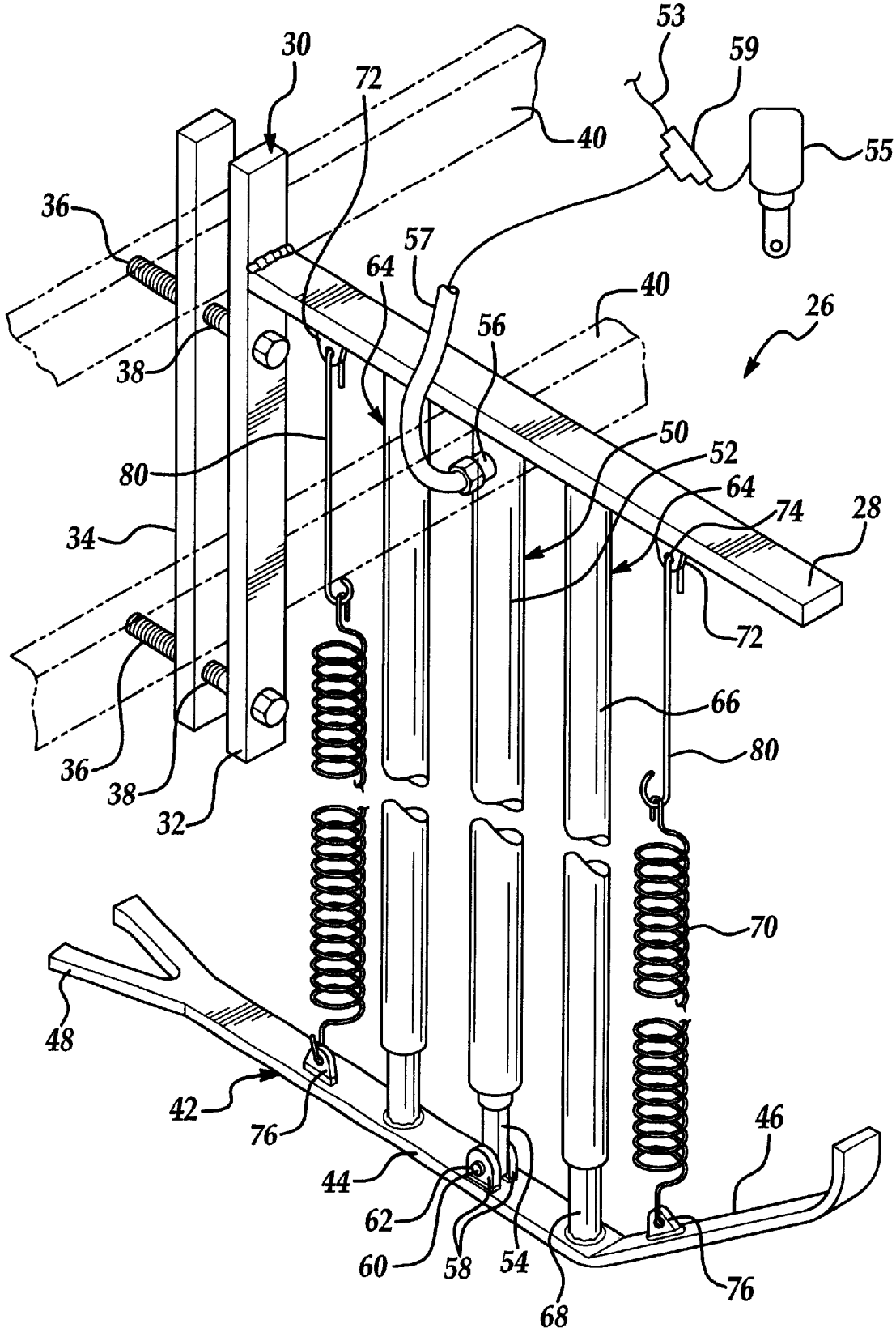
FIG. 2 is a perspective view showing the garment clamp apparatus of FIG. 1 in greater detail.

A machine for pressing shirt sleeves is generally shown at 10 in FIG. 1. The machine 10 includes a housing 12. The housing 12 supports press platens 14. The press platens 14 are movable between an open position, to allow the insertion and removal of the shirt sleeves, and a closed position, as shown in FIG. 1. In the closed position, the platens engage the sleeves 16 of a shirt 18. Movement between the open and closed position is preferably accomplished by a pneumatic drive system.

The housing 12 further supports a movable tray 20. That is, the tray 20 is movable with respect to the housing to allow the shirt sleeves 16, which are supported on sleeve supports 22, to be inserted between the press platens 14 and removed therefrom. This movement allows the shirts 18 to be changed by an operator without interference from the press platens 14.

The tray 20 has fixed thereto a pair of sleeve supports 22. These sleeve supports are also commonly known as bucks. The sleeve supports 22 may include clamps (not shown) for securing the cuffs of the sleeves 16 to the sleeve supports 22. The sleeve supports 22 preferably include inflatable bags. The inflatable bags are inflated with hot air, to heat the sleeves 16 from the inside. Positioning devices may also be employed to assure that the sleeves 18 are positioned on the sleeve supports 22 in the proper orientation. The sleeve supports 22 carried on the tray 20 are movable to a pressing position between the respective press platens 14 and a changing position, in front of the press platens 14 where the shirts 18 and specifically the sleeves 16 can be positioned on the sleeve supports 22 or removed therefrom.

Pneumatic actuators and other structure are typically located directly behind the sleeve supports 22 when the sleeve supports 22 are between the press platens 14. These actuators and other structure are fixed to the housing 12.

The housing 12 also includes at least one, and more often two actuation buttons 24. The actuation buttons are activated by the operator to begin the pressing sequence. Two buttons 24 are preferably provided so that the operator needs both hands to actuate the pressing machine 10 to prevent inadvertent injury to the operator.

Once the machine 10 has been actuated, the sleeve supports 22 are inflated with hot air. The tray 20 carrying the sleeves 16 on the sleeve supports 22 is moved to a position between the open press platens 14. The press platens 14 then close, thus pressing the sleeves 16 therebetween. After the appropriate cycle time is reached, the press platens 14 open and the tray 20 is moved outwardly therefrom. The operator can then remove the shirt 18, by lifting the sleeves 16 off the sleeve supports 22. This cycle is repeated with the next shirt.

The present invention provides an improvement for such a shirt-pressing machine 10. The present invention provides an apparatus for stabilizing the shirt during the pressing operation. The apparatus is generally shown at 26 in the Figures. The apparatus 26 is for engaging the area of the shirt 18 between the sleeves 16 to hold the shirt sleeves 16 taut during the pressing operation.

The apparatus comprises a frame 28. The frame 28 is preferably a piece of metal stock. The frame 28 is secured at one end to a clamp, generally indicated at 30.

The clamp 30 comprises a first clamp member 32 secured to said frame 28. Preferably, the first clamp member 32 is also a piece of metal stock and is welded to the frame 28. It will be appreciated that any method of securing the first clamp member 32 with the frame 28 is contemplated. Further, the frame 28 and first clamp member 32 may be a single piece.

The clamp 30 further comprises a second clamp member 34, preferably of metal stock, moveably secured to the first clamp member 32. More specifically, the clamp 30 includes at least one, and preferably two mounting bolts 36. The mounting bolts 36 connect the first 32 and the second clamp members 34 and allow for relative movement therebetween. Both of the first 32 and second 34 clamp members have holes 38 for receiving the mounting bolts 36. Preferably, the holes 38 on the second clamp member 34 are threaded so that as the bolts 36 are tightened, the second clamp member 34 is drawn toward the first clamp member 32. Loosening of the bolts 36 causes the second clamp member 34 to be moved away from the first clamp member 32. In this manner, a clamp is created between the first 32 and second clamp members 34 to secure the apparatus 26 to the housing 12. Any means can be used for relatively tightening the first 32 and second 34 clamp members. For example, instead of any of the holes 38 being threaded, a nut or other retainer may be used to perform this function.

As shown in FIG. 1, the first clamp member 32 and second clamp member 34 entrap therebetween structure 40 of the housing 12. Thus, the apparatus 26 can be secured to the housing 12. With a clamp 30 made in this matter, the apparatus 26 can be fit onto a model CBS-C cabinet bag sleever available from Ajax of Cincinnati, Ohio, as well as any variety of other shirt pressing machines. Further, the apparatus 26 can be added or retrofit on an existing machine. When the clamp 30 is secured, the frame 28 extends forwardly into the area between the pairs of press platens 14.

It will be appreciated that while straight metal stock connected by bolts is shown to comprise the clamp 30, any design capable of connecting the frame 28 to suitable support structure on the housing 12 may be used without departing from the scope of the present invention. For example, the frame 28 may be attached to the housing 12 by C-clamps or may be welded directly to the housing 12. Further, the first 32 or second 34 clamp members may need to be curved to be secured to the housing 12.

The apparatus 26 includes a foot generally indicated at 42. The foot 42 comprises an elongated contact rail 44. The rail 44 has an upturned end 46 at the forward end thereof. The foot 42, thus, comprises a ski-like member. The foot 42 further includes a branching, curved portion 48 at the rearward end thereof. The curved portion 48 is preferably open to accommodate a structure of the machine 10, such as the main cylinder. Alternative, the curved portion 48, may be closed to provide a closed loop at the rearward end of the foot 42. A closed loop helps prevent the foot 42 from snagging the shirt 18. Preferably the foot 42 is made of aluminum. Aluminum is lightweight and allows for more easy retraction of the foot 42 from the extended position to the retracted position.

The foot 42 is extendable between a retracted position and an extended position. More specifically, the foot 42 is capable of linear movement between a retracted position and an extended position between the pairs of press platens 14. In the retracted position, the foot 42 is drawn near the frame 28, out of contact with the shirt 18. The foot 42 moves linearly downwardly to the extended position wherein the rail 44 contacts the shirt 18. In this position, the rail 44 holds the shirt 18 such that the sleeves 16 remain taut on the sleeve supports 22. Further, the upturned end 46 helps prevent snagging of the foot 42 on the shirt 18 as the foot 42 is moving to the extended position.

Linear movement of the foot 42 from the retracted position to the extended position is accomplished by using a pneumatic cylinder generally indicated at 50 between the frame 28 and the foot 42. The pneumatic cylinder 50 includes a cylinder housing 52 which is secured to the frame 28 at its upper end. The pneumatic cylinder 50 also includes a cylinder shaft 54 which is movably supported by the pneumatic cylinder housing 52 and which is secured to the foot 42 at its lower end. A fluid inlet 56 is disposed in the cylinder housing. The fluid inlet 56 receives a fluid, preferably air, to operate the cylinder 50. The fluid inlet 56 is connected to an air line of the pneumatic system of the machine 10 such as the air line 53 that controls the cylinder (s) 55 which move the press platens 14. This connection of inlet 56 can be accomplished by connecting an air line 57 with an existing air line of the pneumatic system by using an ordinary T-fitting 59, or the like. With this type of connection, the cylinder 50 can be added to the machine 10 with minimal modification of the pneumatic system of the machine 10. Operation of the pneumatic cylinder 50 is well known.

The shaft 54 is connected at its outboard or distal end to the foot 42. As shown, a pair of mounting flanges 58 extends upwardly from the foot 42 and are spaced from one another. Each of the flanges 58 includes a hole 60 therethrough. Similarly, the distal end of the shaft 54 includes a hole therethrough. The holes 60 of the flanges 58 are aligned with the hole in the shaft 54 and a mounting pin 62 is placed through the holes to secured the shaft 54 with the flanges 58.

The volumetric capacity of pneumatic cylinder 50 is preferably sized such that it finishes extending the foot 42 to the extended position just prior to the closing of the press platens 14. Typically, this can be done by sizing cylinder 50 smaller than the cylinder(s) 55 used to move the press platens so that cylinder shaft 54 will be fully extended prior to engagement of the press platens with the shirt sleeves. In this way, the timing of the cycle of the extending of the foot 42 is directly tied to the size of the cylinder housing 52. With the timing done in this manner, it is assured that the foot 42 engages the shirt 18 and therefore holds the sleeves 16 taut before the press plates 14 close to press the sleeves 16. The size of the cylinder housing 52 can be customized so the apparatus can be used on any existing pressing machine.

While a pneumatic cylinder 50 has been disclosed, it will be appreciated that any manner of linearly extending the foot 42 can be used without departing from the scope of the present invention. For example, the foot 42 may be extended using a hydraulic cylinder.

The apparatus 26 further comprises at least one, and preferably two, guide shaft assemblies, generally indicated at 64. The guide shaft assemblies 64 are for guiding movement of the foot 42 between the retracted and the extended positions. The guide assemblies 64 are located on either side of the cylinder 50.

Each guide shaft assembly 64 comprises a receiving tube 66 connected to the frame 28, and an insert shaft 68 connected to the contact rail 44. The insert shaft 68 is slidably received in said receiving tube 66. Movement of the insert shaft 68 within the receiving tube 66 is preferably passive. That is, the insert shaft 68 is not driven, such as by pneumatics, hydraulics or the like. Rather, the guide shaft assemblies 64 are preferably merely to guide movement of the foot 42. Specifically, the guide shaft assemblies 64 prevent twisting movement of the foot 42. Thus, the guide shaft assemblies 64 keep the foot 42 aligned so that the foot 42 is in proper orientation to contact the shirt 18 to hold the sleeves 16.

While the receiving tube 66 is shown to be fixed on the frame 28 and the insert shaft 68 fixed on the foot 42, it will be appreciated that the orientation of the receiving tube 66 and insert shaft 68 may be reversed. That is, the receiving tube 66 may be fixed on the foot 42 and the insert shaft 68 may be fixed on the frame 28. Similarly one receiving tube 66 may be fixed on the frame 28 and the other on the foot 42. In such a case, the insert shafts 68 are fixed on the foot 42 and the frame 28, respectively.

The apparatus 26 further includes a pair of return springs 70 positioned between the frame 28 and the contact rail 44 of the foot 42. The return springs 70 are positioned outboard of the guide shaft assemblies 64 with respect to the ends of the contact rail 44. The return springs 70 are positioned in this manner to provide a uniform force to the contact rail 44 for evenly returning the foot 42 to the retracted position.

The frame 28 includes a pair of spring flanges 72 depending therefrom. The spring flanges 72 have a hole 74 therethrough. Similarly, the elongated rail 44 has a pair of spring flanges 76 secured on the top side thereof. The spring flanges 76 have a hole 78 therethrough.

Each return spring 70 is secured to the holes 74 in the spring flanges 72 of the frame 28 and the holes 78 in the spring flanges 76 of the foot 42. Preferably, each return spring 70 is a coil spring that operates in tension to retract the foot 42 from the extended position to the retracted position. More specifically, the foot 42 extends under force applied by the cylinder 50. This force is sufficient to overcome the force of the return springs 70. The return springs 70 elongate under the force. When the force applied by the cylinder 50 is removed, the return springs 70 return to their unloaded condition. This biasing force of the springs 70 causes the foot 42 to move from the extended position to the retracted position.

A return spring spacer 80 may also be connected between the return spring 70 and the frame 28. The return spring spacer 80 may be used so that a shorter coil spring 70 can be used. Also, the return spring spacer 80 may be used to vary the effective length of the spring 70. That is, as shown in FIG. 1, the rear most return spring 70 is connected to the flat portion of the contact rail 44. The forward most return spring 70 is connected to the upturned end 46 of the contact rail 44. By using return spring spacers 80 having slightly varying sizes, the length of the coil springs 70 used can remain constant.

In operation, the apparatus 26 is connected to the machine 10 by securing the apparatus 26 to the structure 40 of the machine 10 with the clamp 30. Specifically, the first clamp member 32 is positioned on one side of the structure 40. The second clamp member 34 is positioned on the other side of the structure 40. The mounting bolts 36 are secured in the holes 38 and tightened until the first 32 and second 34 clamp members are secured about the structure 40. Further, the pneumatic cylinder 50 is connected to the existing pneumatics of the machine 10 as described above.

Once the apparatus 26 is connected, a shirt 18 is placed on the machine 10, by placing the sleeves 16 over the sleeve supports 22. The operator then initiates operation of the machine 10 by pressing the activation button 24. Once the machine is activated, the tray 20 is moved such that the sleeve supports 22 are drawn inwardly between the press platens 14. The central air system of the machine 10 activates the pneumatic cylinder 50 and extends the foot 42 linearly into contact with the shirt 18. This maintains the sleeves 16 taut on the sleeve supports 22. After the foot 42 contacts the shirt 18, the press platens 14 fully close and perform the pressing operation. Upon completion of the pressing cycle, the pneumatic pressure is relieved from the pneumatic cylinder 50. The biasing forces of the return springs 70 then moves the foot 42 from the extended position to the retracted position, thereby releasing the foot 42 from the garment and allowing the shirt 18 to be removed from the sleeve supports 22. The tray 20 is moved forwardly to the shirt 18 can be removed from the sleeve supports 22 without interference from the platens 14. A new shirt is then placed on the supports 22 and the process is repeated.

Obviously, many modifications and variations of the present invention are possible in light of the above teachings. It is to be understood that the words that have been used are intended to be in the nature of description, rather than of limitation.

What is claimed is:

1. An apparatus for stabilizing a shirt in a shirt sleeve pressing machine that has platens for pressing of the shirt sleeves, said apparatus comprising:

a frame;

a clamp connected to said frame, wherein said clamp has at least one clamp member configured to connect said clamp to the shirt sleeve pressing machine such that said frame extends outwardly between the platens;

a foot located below said frame; and an actuator connected between said frame and said foot, wherein said actuator is operable to move said foot toward and away from said frame;

wherein said frame, actuator, and foot are supported by said clamp.

2. An apparatus as set forth in claim 1 wherein said foot comprises an elongated contact rail, said rail having an upturned end at a forward end thereof.

3. An apparatus as set forth in claim 1 wherein said actuator is operable to move said foot between a retracted position near said frame and a remote position further away from said frame, and wherein said apparatus further comprises at least one guide shaft assembly for guiding movement of said foot between said retracted and said extended positions.

4. An apparatus as set forth in claim 3 wherein said guide shaft comprises a receiving tube connected to one of said frame and said contact rail, and an insert shaft connected to the other of said frame and said contact rail, said insert shaft received in said receiving tube and movable relative thereto.

5. An apparatus as set forth in claim 3 further comprising at least one return spring for moving said foot from said extended position to said retracted position.

6. An apparatus for stabilizing a shirt during the pressing operation of the sleeves comprising:

a frame;

a clamp connected to said frame;

a cylinder connected to said frame;

a foot connected to said cylinder and being movable linearly between a retracted position and an extended position, wherein said foot comprises an elongated contact rail having an upturned end at a forward end thereof, at least one guide shaft assembly for guiding movement of said foot between said retracted and said extended positions; and a pair of said return springs positioned between said frame and said elongated rail for moving said foot from said extended position to said retracted position.

7. An apparatus as set forth in claim 6 further including a return spring spacer connected between said return spring and said frame.

8. An apparatus as set forth in claim 6 further including a pair of said guide shaft assemblies positioned inwardly of said return springs with respect to the ends of said elongated rail.

9. An apparatus as set forth in claim 1 wherein said clamp comprises a first clamp member secured to said frame, and a second clamp member movably attached to said first clamp member.

10. An apparatus as set forth in claim 9 wherein said clamp further comprises at least one mounting bolt, said mounting bolt connecting said first and said second clamp members, and allowing for relative movement therebetween.

11. An apparatus as set forth in claim 1 wherein said actuator comprises a pneumatic cylinder.

12. An apparatus as set forth in claim 11 wherein said pneumatic cylinder includes an air inlet.

13. An apparatus as set forth in claim 12 wherein said pneumatic cylinder comprises a pneumatic cylinder housing and a pneumatic cylinder shaft moveably supported by said pneumatic cylinder housing.

14. A shirt pressing machine comprising:

a housing;

a pair of shirt sleeve supports supported by said housing;

a set of shirt sleeve press platens supported by said housing;

a frame secured to said housing and extending between said shirt sleeve supports;

a foot located below said frame and between said shirt sleeve supports; and an actuator connected between said frame and said foot, wherein said actuator is operable to move said foot toward and away from said frame.

15. A shirt pressing machine comprising:

a housing supporting at least one press platen;

a shirt sleeve support supported by said housing; and an apparatus for stabilizing a shirt, said apparatus comprising:

a frame;

a clamp connected to said frame, said clamp for being secured to said housing;

a cylinder connected to said frame; and a foot connected to said cylinder, said foot movable linearly between a retracted position and an extended position;

wherein said foot comprises an elongated contact rail, said rail having an upturned end at a forward end thereof.

16. A machine as set forth in claim 14 wherein said actuator is operable to move said foot between a retracted position near said frame and a remote position further away from said frame, and wherein said apparatus further comprises at least one guide shaft assembly for guiding movement of said foot between said retracted and said extended positions.

17. A machine as set forth in claim 16 wherein said guide shaft assembly comprises a receiving tube connected to one of said frame and said foot, and an insert shaft connected to the other of said frame and said foot, said insert shaft received in said receiving tube and movable relative thereto.

18. A machine as set forth in claim 16 wherein said apparatus further comprises at least one return spring for moving said foot from said extended position to said retracted positions.

19. A machine as set forth in claim 18 wherein said apparatus includes a pair of said return springs positioned between said frame and said foot.

20. A machine as set forth in claim 19 wherein said apparatus further comprises a return spring spacer connected between each of said return springs and said frame.

21. A machine as set forth in claim 19 wherein said apparatus includes a pair of said guide shaft assemblies positioned inwardly of said return springs with respect to the ends of said foot.

22. A machine as set forth in claim 14 further comprising a clamp, wherein said frame is secured to said housing via said clamp and wherein said frame, actuator, and foot are supported by said clamp.

23. A machine as set forth in claim 22 wherein said clamp comprises a first clamp member secured to said frame and a second clamp member movably attached to said first clamp member.

24. A machine as set forth in claim 14 wherein said actuator comprises a pneumatic cylinder.

25. A machine as set forth in claim 24 wherein said pneumatic cylinder includes an air inlet.

26. A machine as set forth in claim 25 wherein said pneumatic cylinder comprises a pneumatic cylinder housing and a pneumatic cylinder shaft moveably supported by said pneumatic cylinder housing.

27. An apparatus for stabilizing a shirt during the pressing operation of the sleeves comprising:

a frame;

a clamp connected to said frame;

a cylinder connected to said frame; and a foot connected to said cylinder comprising an elongated contact rail having an upturned end at a forward end thereof, wherein said elongated rail includes a branching portion at a rearward end thereof.

28. A shirt pressing machine, comprising:

a housing;

first and second sleeve supports supported by said housing;

a first pair of press platens supported by said housing;

a second pair of press platens supported by said housing;

a first pneumatic cylinder having an input air line for pneumatic control of said cylinder, said first pneumatic cylinder being mechanically coupled to at least said first pair of press platens such that said first pair of press platens are movable between an open position in which they are spaced from said first sleeve support and a closed position in which they are in contact with said first sleeve support; and a garment clamping apparatus that includes:

a frame supported by said housing;

a foot; and a second pneumatic cylinder connected between said frame and said foot such that said foot is movable relative to said frame between a retracted position and an extended position;

wherein said second pneumatic cylinder includes an input air line connected to said input air line of said first pneumatic cylinder, whereby said first and second pneumatic cylinders can be operated using a single pneumatic control line.

29. A machine as set forth in claim 28, wherein said second pneumatic cylinder is sized relative to said first pneumatic cylinder such that, upon activation of said pneumatic cylinders via said input air lines, said foot reaches said extended position prior to said first pair of press platens reaching said closed position.

30. A machine as set forth in claim 28, wherein said foot moves linearly between said retracted and extended positions.

31. A machine as set forth in claim 28, wherein said foot comprises an elongated contact rail, said rail having an upturned end at a forward end thereof.

32. A machine as set forth in claim 28, wherein said apparatus further comprises at least one guide shaft assembly for guiding movement of said foot between said retracted and said extended positions.

33. A machine as set forth in claim 32, wherein said guide shaft assembly comprises a receiving tube connected to one of said frame and said foot, and an insert shaft connected to the other of said frame and said foot, said insert shaft received in said receiving tube and moveable relative thereto.

34. A machine as set forth in claim 28, wherein said apparatus further comprises at least one return spring for moving said foot from said extended position to said retracted positions.

35. A machine as set forth in claim 34, wherein said apparatus includes a pair of said return springs positioned between said frame and said foot.

36. A machine as set forth in claim 35, wherein said apparatus includes a pair of said guide shaft assemblies positioned inwardly of said return springs with respect to the ends of said foot.

37. A machine as set forth in claim 34, wherein said apparatus further comprises a return spring spacer connected between said return spring and said frame.

* * * * *